United States Patent [19]

Miyazaki et al.

[11] Patent Number: 4,511,903

[45] Date of Patent: Apr. 16, 1985

[54] THERMAL PRINTER

[75] Inventors: Naoki Miyazaki, Suntoh; Keiichi Horiya, Numazu; Tsugio Shiozaki, Susono; Kazuhide Takahama, Tagata, all of Japan

[73] Assignee: Tokyo Electric Co., Ltd., Tokyo, Japan

[21] Appl. No.: 542,670

[22] Filed: Oct. 17, 1983

[30] Foreign Application Priority Data

Oct. 18, 1982 [JP] Japan ..... 57-182291

[51] Int. Cl.[3] ..... B41J 3/02

[52] U.S. Cl. ..... 346/76 PH; 400/120; 400/207

[58] Field of Search ..... 400/191, 196, 196.1, 400/194, 195, 207, 208, 208.1, 249, 219, 120; 346/76 PH, 76 R; 219/216 PH; 250/316.1, 317.1

[56] References Cited

U.S. PATENT DOCUMENTS

| | | | |
|---|---|---|---|
| Re. 29,832 | 11/1978 | Hayakawa | 400/120 |
| 4,345,845 | 8/1982 | Bohnhoff et al. | 346/76 PH |
| 4,468,139 | 8/1984 | Hattori | 400/120 |

FOREIGN PATENT DOCUMENTS 2646336 4/1978 Fed. Rep. of Germany .

*Primary Examiner*—E. A. Goldberg
*Assistant Examiner*—A. Evans
*Attorney, Agent, or Firm*—Oblon, Fisher, Spivak, McClelland & Maier

[57] ABSTRACT

In a thermal printer of this invention, a detector detects whether a ribbon cassette exists or not, and the thermal printer is automatically changed in thermal sensitive process or thermal transfer process by installing or detaching the ribbon cassette.

6 Claims, 5 Drawing Figures

THERMAL PRINTER

FIELD OF THE INVENTION

The present invention relates to a thermal printer in which a large number of heating elements in linear arrangement are selectively made conductive thereby dots are formed at thermal condition so as to perform printing.

OBJECTS OF THE INVENTION

It is a first object of the invention to provide a thermal head printer in which changing of thermal sensitive process and thermal transfer process is performed automatically by installing or detaching a ribbon cassette.

It is a second object of the invention to provide a thermal printer in which supply voltage to a thermal head is directly controlled by output of a detector for detecting whether a ribbon cassette exists or not.

It is a third object of the invention to provide a thermal printer in which supply voltage being different from that in use state is not applied to a thermal head.

DESCRIPTION OF THE PRIOR ART

Figure 1:
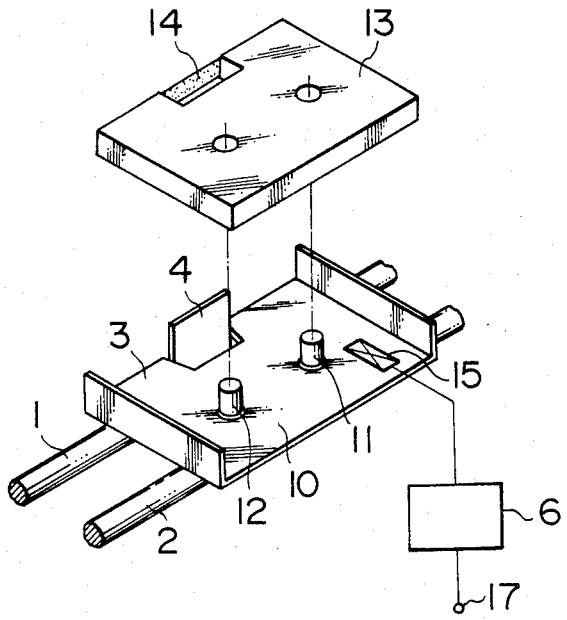
FIG. 1 is a perspective view of a thermal printer as an embodiment of the invention.

In general, there are two sorts of thermal printers, i.e. thermal sensitive process in which a heat sensitive paper is used as a recording medium and color development is performed on the heat sensitive paper and thermal transfer process in which a printing ribbon coated with thermal fusion ink is contacted to a paper and the heating is performed using a thermal head so as to transfer the ink. The thermal sensitive process requires a higher temperature of the thermal head than that in other process. In a thermal printer which can act in both processes, a voltage changing switch is installed to change the heating temperature corresponding to both processes. If operation of the voltage changing switch is mistaken in this constitution, printing of required quality cannot be obtained.

DESCRIPTION OF THE PREFERRED EMBODIMENT

Two guide shafts 1, 2 are arranged in parallel, and a carriage 3 is mounted on the guide shafts 1, 2 and movable in reciprocating motion. A thermal head 4 is attached to the carriage 3 at side of a platen (not shown). One guide shaft 2 can be moved about other guide shaft 1 so that the thermal head 4 is contacted to or separated from a paper. The thermal head 4 has a large number of heating elements 5 which are connected through a driver 7 and a shift register 8 to CPU 9 in a control circuit 6.

A cassette holding member 10 is provided on the carriage 3, and a taking shaft 11 and a driven shaft 12 connected to a driving unit (not shown) are installed on the cassette holding member 10. A ribbon cassette 13 has a spool (not shown) fitted to the taking shaft 11 and the driven shaft 12, and a printing ribbon 14 coated with thermal fusible ink is enclosed in the ribbon cassette 13.

On the carriage 3 is installed a detector 15 comprising a microswitch or the like to turn ON when the ribbon cassette 13 is installed. The detector 15 is connected to the CPU 9 in the control circuit 6, and the CPU 9 is connected to a driving voltage switching circuit 16, which in turn is connected through a head voltage supply terminal 17 to the thermal head 4.

In such constitution, if the ribbon cassette 13 is not installed on the cassette holding member 10 of the carriage 3, the thermal printer acts in thermal sensitive process to use a heat sensitive paper; if the ribbon cassette 13 is installed thereon, it acts in thermal transfer process. Referring to a flow chart in FIG. 3, operation starts and is initialized, and the detector 15 detects whether the ribbon cassette 13 exists or not, i.e. whether the detector 15 turns ON or OFF. The detecting signal is supplied to the CPU 9. If the detector 15 turns OFF, the thermal printer acts in thermal sensitive process and therefore thermal sensitive voltage is set through the CPU 9 and the driving voltage switching circuit 16. If the detector 15 turns ON, the thermal printer acts in thermal transfer process and therefore thermal transfer voltage is set. Thus corresponding voltage is set to the thermal head, and then data is taken and editted and printed. Thereby the heating temperature of the thermal head 4 becomes suitable for both processes respectively and optimum printing quality is obtained.

In practice, the detector 15 may be a type to utilize a photo-electric converter.

Figure 2:
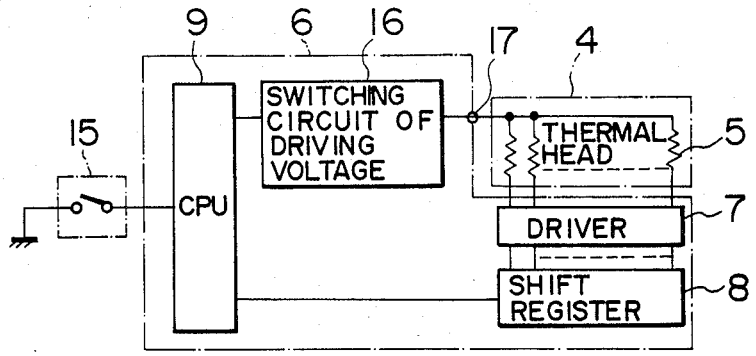
FIG. 2 is a block diagram of the thermal printer.
Figure 3:
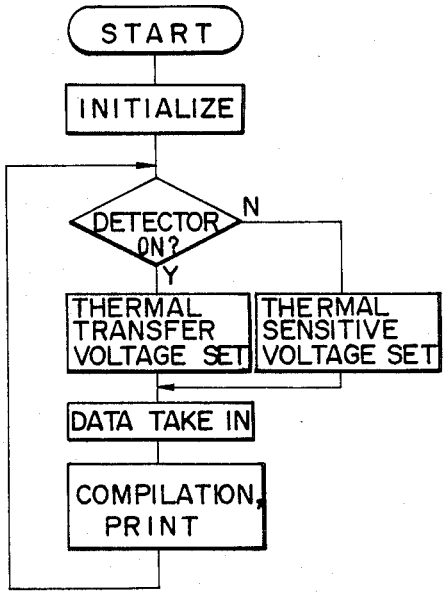
FIG. 3 is a flow chart of the thermal printer.
Figure 4:
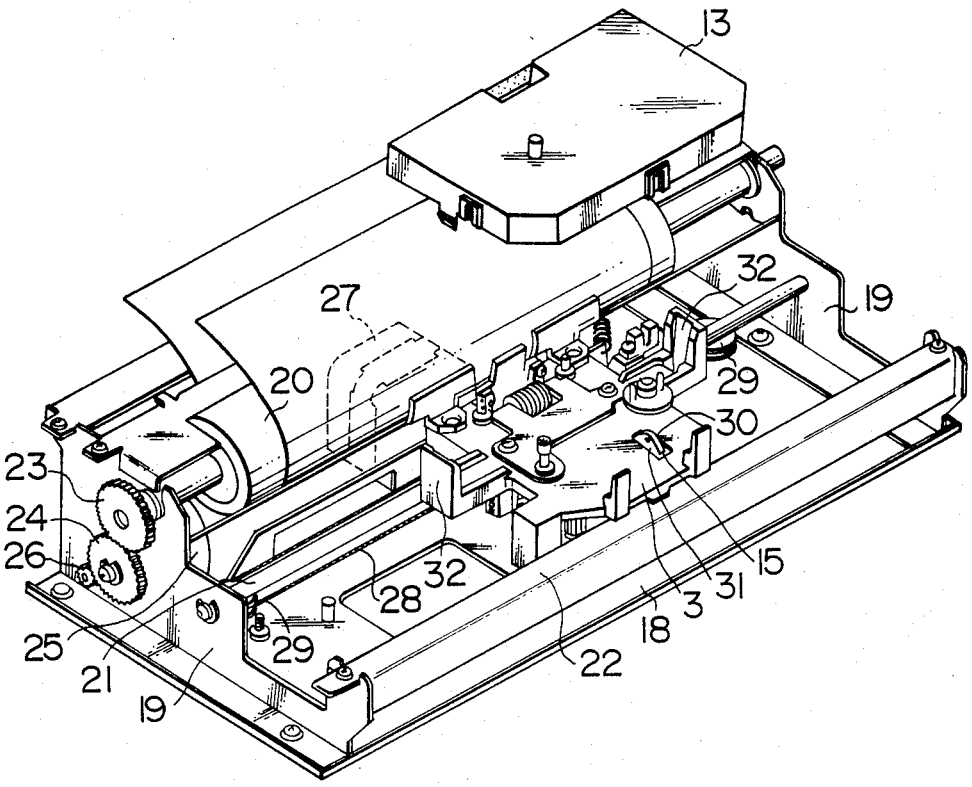
FIG. 4 is a perspective view of a thermal printer constituted specifically.
Figure 5:
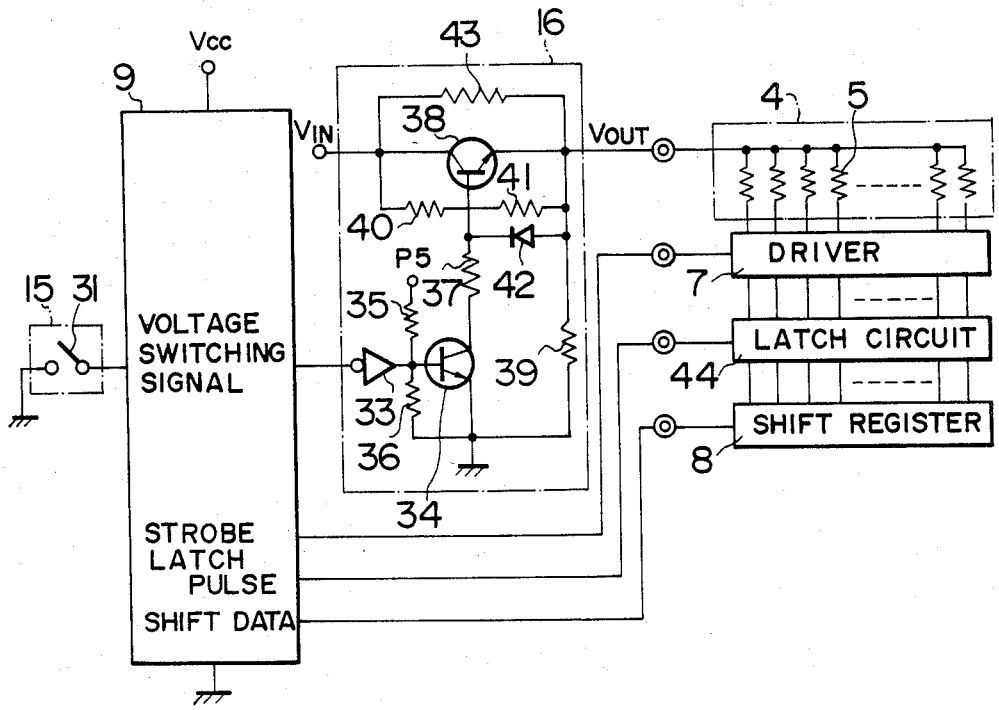
FIG. 5 is a circuit diagram of a drive voltage adjusting circuit.

Apparatus and circuit in more specific constitution will now be described referring to FIG. 4 and FIG. 5. Like parts to those in FIGS. 1–3 are designated by the same reference numerals respectively in FIG. 4 and FIG. 5, and the description will be omitted. Frames 19 extend vertically and are opposed to each other and fixed on both sides of a chassis 18 of flat plate form. A platen 20, a guide shaft 21 and a guide plate 22 for turning and holding a paper are hung respectively between the frames 19. A gear 23 is fixed to end portion of the platen 20 and meshed with an intermediate gear 24 which in turn is meshed with a drive gear 26 of a paper feed motor 25.

A carriage 3 is installed to the guide shaft 21 and the guide plate 22 and movable in reciprocating motion. A wire 28 driven by a pulse motor 27 is connected to the carriage 3 and hung between pulleys 29 installed on both ends. A thermal head 4 is installed to the carriage 3 at side of the platen 20, a taking shaft 11 and a driven shaft 12 are projected upwards at center portion, and a detector 15 comprising a microswitch 31 with an actuator 30 projecting upwards is installed at front side.

A holding member 32 for detachably holding a ribbon cassette 13 is formed on periphery of the carriage 3, and the ribbon cassette 13 held by the holding member 32 pushes the actuator 30 of the microswitch 31 thereby the switching is performed.

The microswitch 31 is connected to CPU 9 which is driven by power source $V_{CC}$, and voltage switching signal line of the CPU 9 is connected to a buffer IC 33 of a driving voltage switching circuit 16, and the buffer IC 33 in turn is connected to base of a transistor 34. The base is connected to voltage dividing resistors 35, 36 from power source $P_5$. Collector of the transistor 34 is connected through a resistor 37 to base of a transistor 38. Collector of the transistor 38 is at power source side designated by $V_{IN}$, and emitter thereof is designated by $V_{OUT}$ and connected to the thermal head 4. The emitter is grounded through a resistor 39. A resistor 40 is connected across base - collector of the transistor 38, a resistor 41 and a diode 42 are connected across base - emitter, and a resistor 43 is connected across collector - emitter.

A driver 7, a latch circuit 44 and a shift register 8 are sequentially connected to various heating elements 5 of the thermal head 4. The driver 7 is connected to strobe line of the CPU 9, the latch circuit 44 is to latch pulse line, and the shift register 8 is to shift data line.

In above-mentioned constitution, when the ribbon cassette 13 is installed, the microswitch 31 turns ON and voltage switching signal becomes L level. As a result, since the transistor 34 is rendered ON and the transistor 38 is OFF, power source $V_{IN}$ passes through resistors 43, 40, 41 and becomes $V_{OUT}$. Thereby transfer voltage $V_R$ suited for thermal transfer process is obtained. When the ribbon cassette 13 is removed, voltage switching signal becomes H level thereby the transistor 34 is rendered OFF and the transistor 38 is ON. In this state, $V_{OUT}$ becomes thermal sensitive voltage $V_T$ without being dropped by the resistors. Accordingly, voltage values suited respectively to thermal transfer process and thermal sensitive process are automatically obtained by installing or detaching the ribbon cassette 13.

What is claimed is:

1. A thermal printer comprising:

a platen to hold a paper;

a carriage moveable in reciprocating motion along the platen;

athermal head attached to the carriage;

a ribbon cassette enclosing a printing ribbon coated with thermal fusible ink, said cassette being attachable to the carriage;

means for supplying a supply voltage to the thermal head to heat the thermal fusible ink or the paper;

a detector for detecting whether the ribbon cassette is attached to the carriage; and a driving voltage switching circuit for varying the supply voltage to the thermal head in response to the output of the detector in order to heat either the thermal fusible ink or the paper;

2. A thermal printer as set forth in claim 1, wherein the thermal printer acts in thermal sensitive process to use a heat sensitive paper when the ribbon casssette is not attached.

3. A thermal printer as set forth in claim 1, wherein the thermal printer acts in thermal transfer process to transfer ink from the printing ribbon to an ordinary paper when the ribbon cassette is installed.

4. A thermal printer as set forth in claim 1, wherein the detector comprises a microswitch to perform switching in response to pressure of the ribbon cassette.

5. A thermal printer as set forth in claim 1, wherein the detector comprises a photo-electric converter.

6. A thermal printer as set forth in claim 1, wherein the driving voltage switching circuit comprises transistors to be rendered ON or OFF and resistors to be connected in parallel to the transistors in response to output from the detector.

* * * * *